US010575612B2

(12) United States Patent
Meservey

(10) Patent No.: US 10,575,612 B2
(45) Date of Patent: Mar. 3, 2020

(54) BACKPACK WITH LAPTOP SLEEVE CONVERTIBLE TO LAPTOP SLEEVE WITH STORED BACKPACK PORTION

(71) Applicant: DayMen Canada Acquisition ULC, Vancouver (CA)

(72) Inventor: George Meservey, Petaluma, CA (US)

(73) Assignee: VITEC HOLDINGS ITALIA SRL, Richmond (GB)

( * ) Notice: Subject to any disclaimer, the term of this patent is extended or adjusted under 35 U.S.C. 154(b) by 0 days.

(21) Appl. No.: 15/362,723

(22) Filed: Nov. 28, 2016

(65) Prior Publication Data

US 2018/0146756 A1 May 31, 2018

(51) Int. Cl.

| | |
|---|---|
| ***A45C 7/00*** | (2006.01) |
| ***A45F 3/04*** | (2006.01) |
| ***A45F 4/00*** | (2006.01) |
| ***A45C 9/00*** | (2006.01) |
| ***A45C 11/00*** | (2006.01) |
| ***A45F 4/02*** | (2006.01) |
| ***A45C 13/10*** | (2006.01) |
| ***A45C 13/02*** | (2006.01) |

(52) U.S. Cl.

CPC ..... *A45C 9/00* (2013.01); *A45C 11/00* (2013.01); *A45C 13/02* (2013.01); *A45C 13/10* (2013.01); *A45C 13/103* (2013.01); *A45C 13/1076* (2013.01); *A45F 3/04* (2013.01); *A45F 4/00* (2013.01); *A45F 4/02* (2013.01); *A45C 2009/007* (2013.01); *A45C 2011/003* (2013.01); *A45C 2013/025* (2013.01); *A45C 2013/1015* (2013.01); *A45F 2200/0525* (2013.01)

(58) Field of Classification Search

CPC .... A45F 2004/023; A45C 7/00–7/0095; A45C 7/0045; A45C 7/0086

USPC ..... 224/581, 583

See application file for complete search history.

(56) References Cited

U.S. PATENT DOCUMENTS 3,830,348 A * 8/1974 Ohyama ..... A45C 7/0077 190/107
4,018,369 A * 4/1977 Jaeger ..... A45F 3/04 224/582
4,236,657 A * 12/1980 Brunton ..... A45F 3/04 190/111

(Continued)

OTHER PUBLICATIONS

Solo Urban Convertible Laptop Briefcase Backpack, https://www.bestbuy.com/site/solo-urban-convertible-laptop-briefcase-backpack-gray/3972016.p?skuId=3972016&ref=212&loc=1&extStoreId=524&ds_r1=1260666&ds_r1=1266837&ref=212&loc=1&ds_r1=1266837&gclid=EAIaIQobChMImofgv_O93wIVxGSGCh1ShwwHEAQYASABEgJ3S_D_BwE&gclsrc=aw.ds, accessed Aug. 2016.

(Continued)

*Primary Examiner* — Brian D Nash

(74) *Attorney, Agent, or Firm* — Medler Ferro Woodhouse & Mills PLLC

(57) ABSTRACT

A backpack includes a backpack portion defining an interior compartment and a sleeve. The sleeve defines an interior cavity configured to receive a laptop therein and a storage compartment configured to receive the backpack portion therein. The sleeve is coupled to an inner surface of the backpack portion. The backpack includes a first configuration and a second configuration, wherein in the first configuration the sleeve is disposed within the interior compartment of the backpack portion, and in the second configuration the backpack portion is disposed within the storage compartment of the sleeve.

17 Claims, 17 Drawing Sheets

(56) References Cited

U.S. PATENT DOCUMENTS 4,301,849 A * 11/1981 Litwack ..... A45C 13/08 150/103
4,334,601 A * 6/1982 Davis ..... A45C 3/00 190/111
4,389,735 A * 6/1983 McLaughlin ..... A41D 15/04 2/94
4,563,777 A * 1/1986 Park ..... A41D 15/04 2/108
4,901,897 A * 2/1990 Briggs ..... A45C 3/004 206/287.1
4,961,522 A * 10/1990 Weber ..... A45C 3/00 190/119
D323,237 S * 1/1992 Zoltie ..... D2/831
5,217,119 A * 6/1993 Hollingsworth ..... G06F 1/1628 190/102
5,361,951 A 11/1994 Chehebar
5,370,113 A * 12/1994 Parsons ..... A41D 15/04 128/202.13
5,377,877 A 1/1995 Garcia
5,706,992 A 1/1998 Moor
5,743,448 A 4/1998 Tsai
5,887,770 A * 3/1999 Covell ..... A45C 13/30 150/102
5,894,975 A * 4/1999 Holden ..... A45C 1/024 150/101
5,964,384 A * 10/1999 Young ..... A45C 7/0063 190/103
6,015,072 A * 1/2000 Young ..... A45C 7/0063 190/103
D441,190 S * 5/2001 Eskandry ..... D3/216
6,230,771 B1 * 5/2001 Hellenbrand ..... A45C 3/00 150/111
6,305,587 B1 * 10/2001 Miller ..... A45C 7/0068 224/153
6,393,745 B1 * 5/2002 Miki ..... G09F 27/00 224/627
6,394,328 B1 * 5/2002 Zakarin ..... A45F 3/04 150/108
6,536,638 B1 * 3/2003 Gulmatico, III ..... A45C 7/0077 224/153
7,363,659 B1 * 4/2008 Colbert ..... A41D 3/00 2/86
7,374,071 B2 5/2008 Lavelle
7,575,376 B2 * 8/2009 Yu ..... A45C 7/0077 190/103
7,600,619 B2 * 10/2009 Sapyta ..... A45C 7/0054 190/107
7,788,736 B2 * 9/2010 Gollin ..... A41D 3/00 2/467
D690,502 S * 10/2013 Bergquist ..... D3/216
8,567,652 B2 * 10/2013 Di Stasio ..... A45F 3/047 224/578
8,590,759 B1 * 11/2013 Mooney ..... A45F 3/04 224/581
8,814,016 B2 * 8/2014 Murdoch ..... A45F 3/04 224/581
8,820,596 B1 * 9/2014 Bergquist ..... A45F 4/02 224/153
8,960,509 B2 2/2015 Rathbun
9,554,601 B2 * 1/2017 Arajakis ..... A41D 3/005
9,717,322 B1 * 8/2017 Bergquist ..... A45F 4/00
9,737,100 B2 * 8/2017 McIntire, Jr. ..... A41D 15/04
9,801,441 B2 * 10/2017 Lai ..... A45C 1/02
2003/0015559 A1 1/2003 Oh
2006/0289582 A1 * 12/2006 Killilea ..... A45C 7/0095 224/577
2007/0045370 A1 * 3/2007 Hsieh ..... A45C 5/14 224/576
2007/0125815 A1 * 6/2007 Tong ..... A45C 5/14 224/153
2007/0175941 A1 * 8/2007 Berry ..... A45C 7/0077 224/583
2009/0266860 A1 * 10/2009 Schneider Barterian ..... A45C 3/001 224/581
2010/0243692 A1 9/2010 Sabbah
2011/0186611 A1 * 8/2011 Eberle ..... A45F 4/00 224/583
2011/0284598 A1 11/2011 Lawson

OTHER PUBLICATIONS

Ace Laptop Backpack Messenger Bag https://www.timbuk2.com/products/354-ace-laptop-backpack-messenger-bag-sale?variant=13539623731242, accessed Aug. 2016.

Hedgren Kayla Convertible Laptop Backpack Tote, https://www.ebags.com/hproduct/hedgren/kayla-backpack/288341?productid=10345623&cat=work-totes&country=US&currency=USD&sourceid=ADWPRODUCTB&adtype=pla&gclid=EAlalQobChMlh63yhfg93wlVzF6GCh2mzw2nEAQYASABEgLT9_D_BwE , accessed Aug. 2016.

* cited by examiner

BACKPACK WITH LAPTOP SLEEVE CONVERTIBLE TO LAPTOP SLEEVE WITH STORED BACKPACK PORTION

FIELD OF THE INVENTION

The present invention relates to a storage device, and more specifically, a backpack with a laptop sleeve disposed therein convertible to a laptop sleeve with on-board storage of the backpack.

BACKGROUND

Backpacks may have sleeves incorporated into the interior compartment to store items such as a laptop computer, known generally as a laptop. However, in situations where only a laptop is needed, carrying the backpack may be more bulky than required or desired. In such cases, only a laptop sleeve is preferred. Conversely, there may occur situations where a user with only the laptop in the laptop sleeve acquires additional items and thus needs the additional storage space of a backpack to transport the laptop and the additional items.

Accordingly, there exists a need for a storage device that easily and quickly converts from a backpack with a laptop sleeve disposed therein to a laptop sleeve with a stored backpack portion, and vice versa. It is also desirable that such a storage device can make such a conversion without removal of the laptop disposed within the laptop sleeve.

SUMMARY OF THE INVENTION

Embodiments hereof relate to a backpack including a backpack portion and a sleeve. The backpack portion defines an interior compartment accessible through an opening. The sleeve defines an interior cavity configured to receive a laptop therein and a storage compartment configured to receive the backpack portion therein. The sleeve is coupled to an inner surface of the backpack portion. The backpack includes a first configuration and a second configuration, wherein in the first configuration the sleeve is disposed within the interior compartment of the backpack portion, and in the second configuration the backpack portion is disposed within the storage compartment of the sleeve.

Embodiments hereof also relate to a backpack including a backpack portion and a sleeve. The backpack portion defines an interior compartment accessible through an opening. The sleeve defines an interior cavity configured to receive a laptop therein. The sleeve is coupled to an inner surface of the backpack portion along only a single edge portion of the sleeve. The backpack includes a first configuration and a second configuration, wherein in the first configuration the sleeve is disposed within the interior compartment of the backpack portion, and in the second configuration the backpack portion is disposed within the interior cavity of the sleeve.

Embodiments hereof also relate to a storage device include a storage portion and a sleeve. The storage portion defines an interior compartment accessible through an opening. The sleeve defines an interior cavity and a storage compartment. The interior cavity is configured to receive a laptop therein. The sleeve is coupled to an inner surface of the storage portion. The storage device includes a first configuration and a second configuration, wherein in the first configuration the sleeve is disposed within the interior compartment of the storage portion, and in the second configuration the storage portion is disposed within the storage compartment of the sleeve.

BRIEF DESCRIPTION OF DRAWINGS

The foregoing and other features and advantages of the invention will be apparent from the following description of embodiments hereof as illustrated in the accompanying drawings. The accompanying drawings, which are incorporated herein and form a part of the specification, further serve to explain the principles of the invention and to enable a person skilled in the pertinent art to make and use the invention. The drawings are not to scale.

DETAILED DESCRIPTION

Specific embodiments of the present invention are now described with reference to the figures, wherein like reference numbers indicate identical or functionally similar elements. Although the description of embodiments hereof is in the context of a backpack and a laptop sleeve, the invention may also be used with other storage devices. Furthermore, there is no intention to be bound by any expressed or implied theory presented in the preceding technical field, background, brief summary, or the following detailed description.

Figure 1:
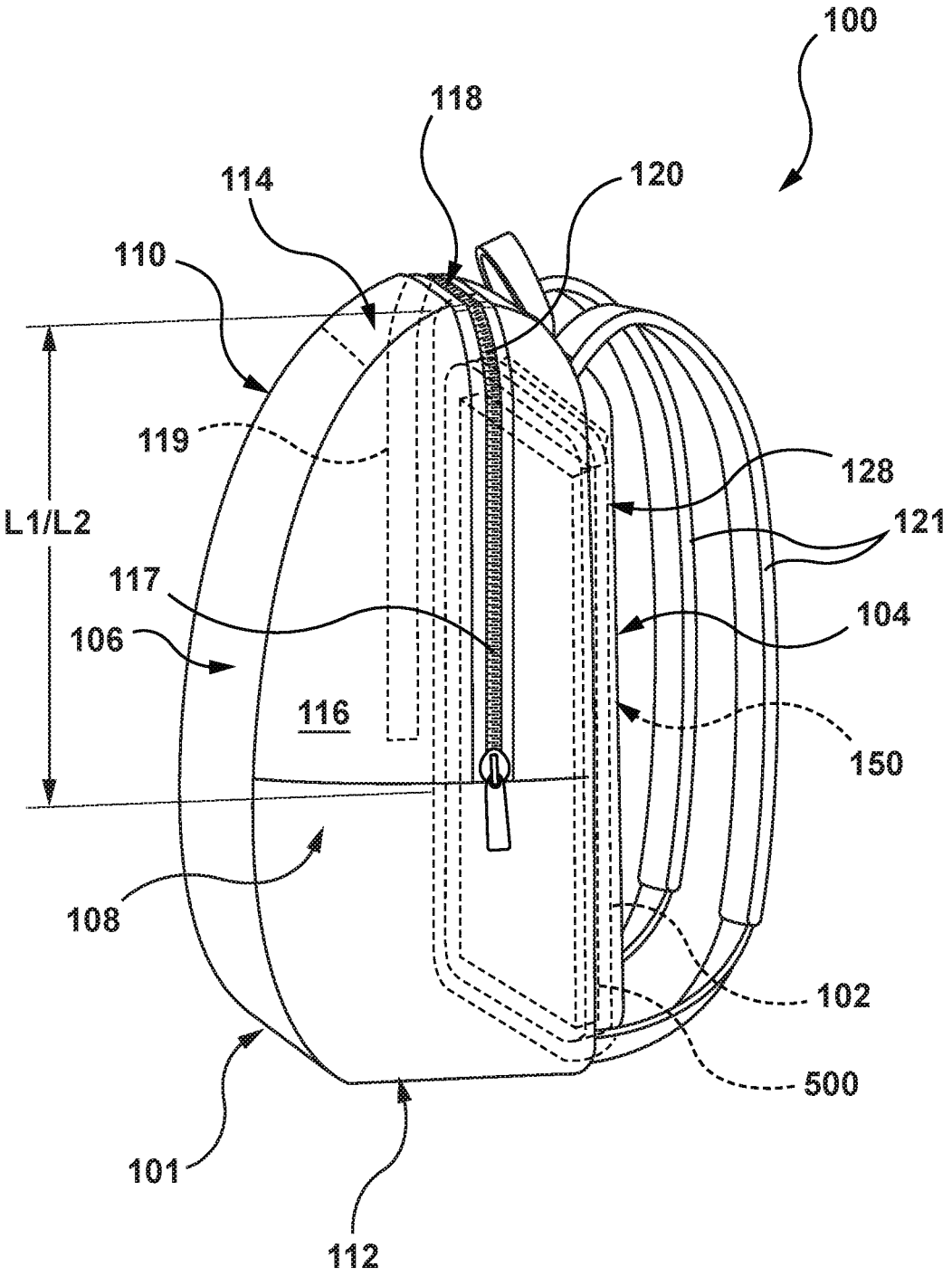
FIG. 1 is a perspective illustration of a backpack in accordance with an embodiment hereof.
Figure 2:
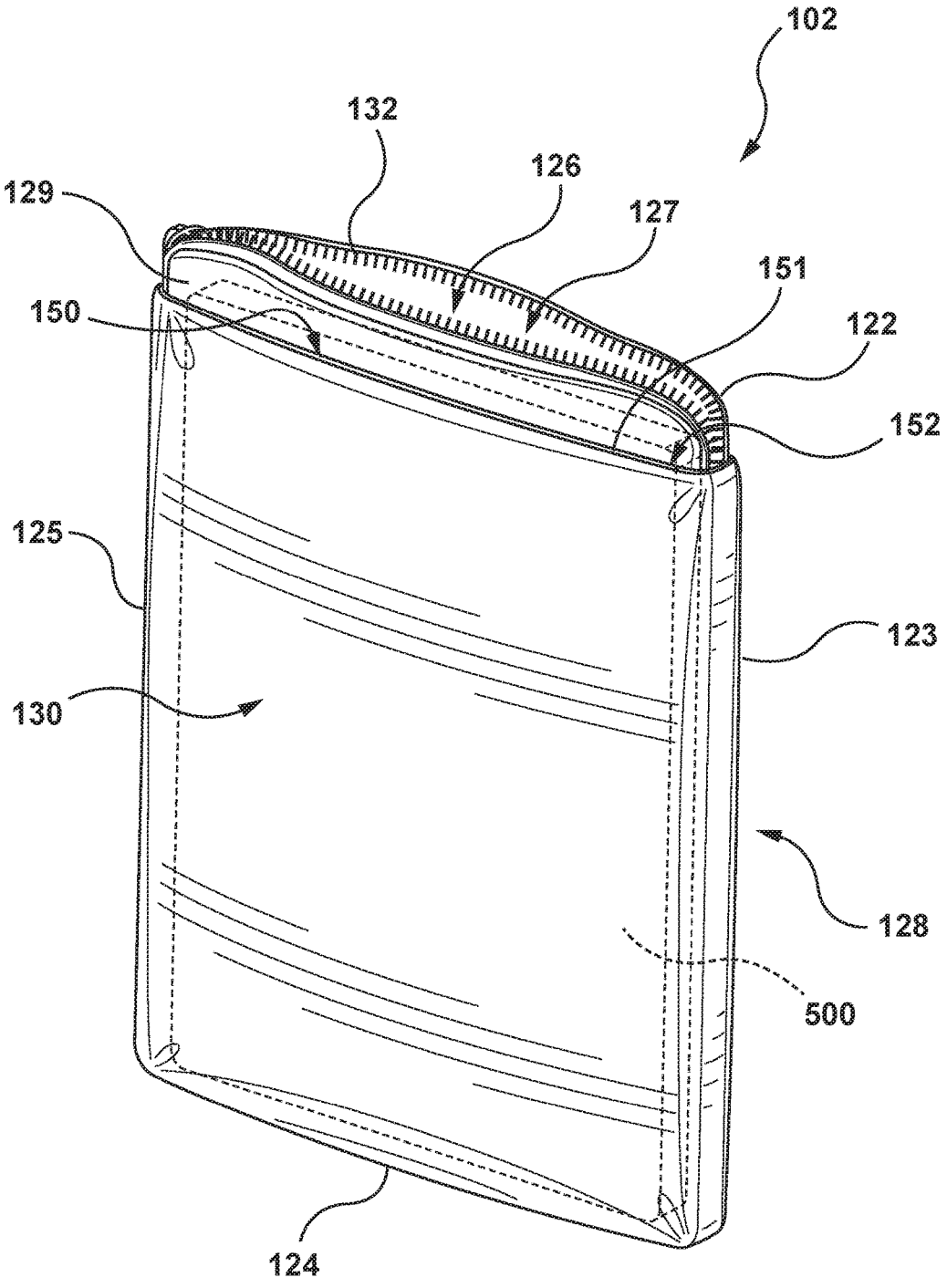
FIG. 2 is a perspective illustration of a sleeve of the backpack of FIG. 1 in accordance with an embodiment hereof.
Figure 3:
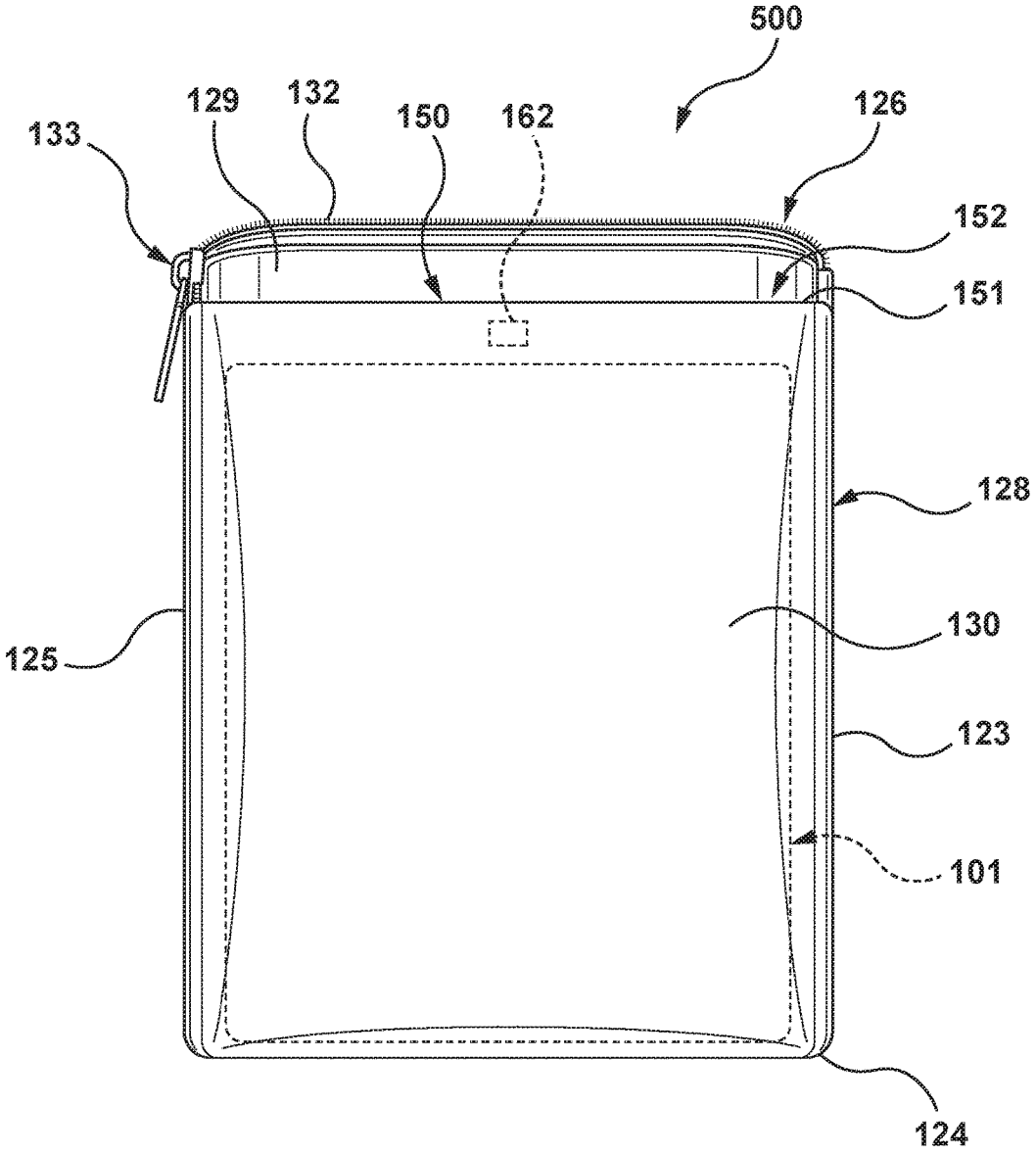
FIG. 3 is a front illustration of the sleeve of FIG. 2.

Referring to FIGS. 1-3, an embodiment of a backpack 100 is shown. In the embodiment of FIGS. 1-3, the backpack 100 includes a backpack portion 101 and sleeve 102. The backpack portion 101 includes a rear panel 104, a front panel 106, a first side panel 108, a second side panel 110, a bottom panel 112, and a top panel 114, as shown in FIG. 1. Although the panels are labeled in terms of direction, such terms are relative to the orientation of the backpack 100 and can be interchanged. The rear panel 104, the front panel 106, the first side panel 108, the second side panel 110, the bottom panel 112, and the top panel 114 define an interior compartment 116. An opening 118 is provided as part of the top panel 114, the first side panel 108, and the second side panel 110. More specifically, the opening 118 includes a first portion 117 along the first side panel 108 and a second portion 119 along the corresponding second side panel 110. The opening 118 provides access to the interior compartment 116. In an embodiment, the opening 118 includes a closure device 120. The closure device 120 may be configured to releasably secure (close) the opening 118. In an embodiment, the closure device 120 of the opening 118 may be a zipper, while in other embodiments the closure device 120 may be a button, snap, hook and loop mechanism, or any other device suitable for the purposes of closing the opening 118. The rear panel 104, the front panel 106, the first side panel 108, the second side panel 110, the bottom panel 112, and the top panel 114 may be formed integrally or may be separate panels coupled to each other by methods such as, but not limited to stitching or other methods suitable for the purposes described herein.

Referring to FIGS. 2-3, in an embodiment, the sleeve 102 generally includes an interior cavity 126 and a storage compartment 150. The interior cavity 126 is configured to receive a laptop 500 therein (FIG. 3). The laptop 500 referenced herein may be a laptop computer, tablet, or other electronic device suitable for storage within the interior cavity 126. The storage compartment 150 is configured to store the backpack portion 101 of backpack 100 therein when the backpack 100 is in a second or sleeve configuration, as described in more detail below. The sleeve 102 includes a first end 122, a second end 124 opposite the first end 122, a first side 123, and a second side 125 opposite the first side 123. In an embodiment, the sleeve 102 is formed from a front panel 128, an intermediate panel 129, and a rear panel 130. In the views of FIGS. 2-3, the rear panel 130 is facing outward. The front panel 128, the intermediate panel 129, and the rear panel 130 are coupled together along the first side 123, the second end 124, and the second side 125. For example, and not by way of limitation, the panels 128, 129, 130 may be stitched together along their side and second end borders.

The front panel 128 and the intermediate panel 129 define the interior cavity 126 therebetween. At the first end 122 of the sleeve 102, an opening 127 is formed between the front panel 128 and the intermediate panel 129, providing access to the interior cavity 126. The opening 127 may include a closure device 132 configured to releasably secure (close) the opening 127. In the embodiment shown in FIGS. 2-3, the closure device 132 of the sleeve 102 may be a zipper including a zipper closure 133. However, this is not meant to be limiting, and in other embodiments, the closure device 132 may be a flap, hook and loop mechanism, buttons, snaps, or any other closure mechanism suitable for the purposes described herein. The interior cavity 126 is sized and shaped to accommodate the laptop 500. Other sizes of the interior cavity may be utilized for sleeves specifically designed for different sizes of electronic devices, if desired.

The storage compartment 150 is formed between the intermediate panel 129 and the rear panel 130. A first end 151 of the rear panel 130 forms an opening 152 between the intermediate panel 129 and the rear panel 130, providing access to the storage compartment 150. In the embodiment of FIGS. 2-3, the storage compartment 150 is formed as a slash pocket. However, other types of compartments may be utilized instead of a slash pocket. The storage compartment 150 may include a closure device 162. For example, and not by way of limitation, the closure device 162 may include a hook or loop material on an outer surface of the intermediate panel 129 and a corresponding loop or hook material aligned therewith on an inner surface of the rear panel 130. However, other closure device, such as snaps, magnetic closures, zippers, and similar closure devices may be utilized.

Figure 8:
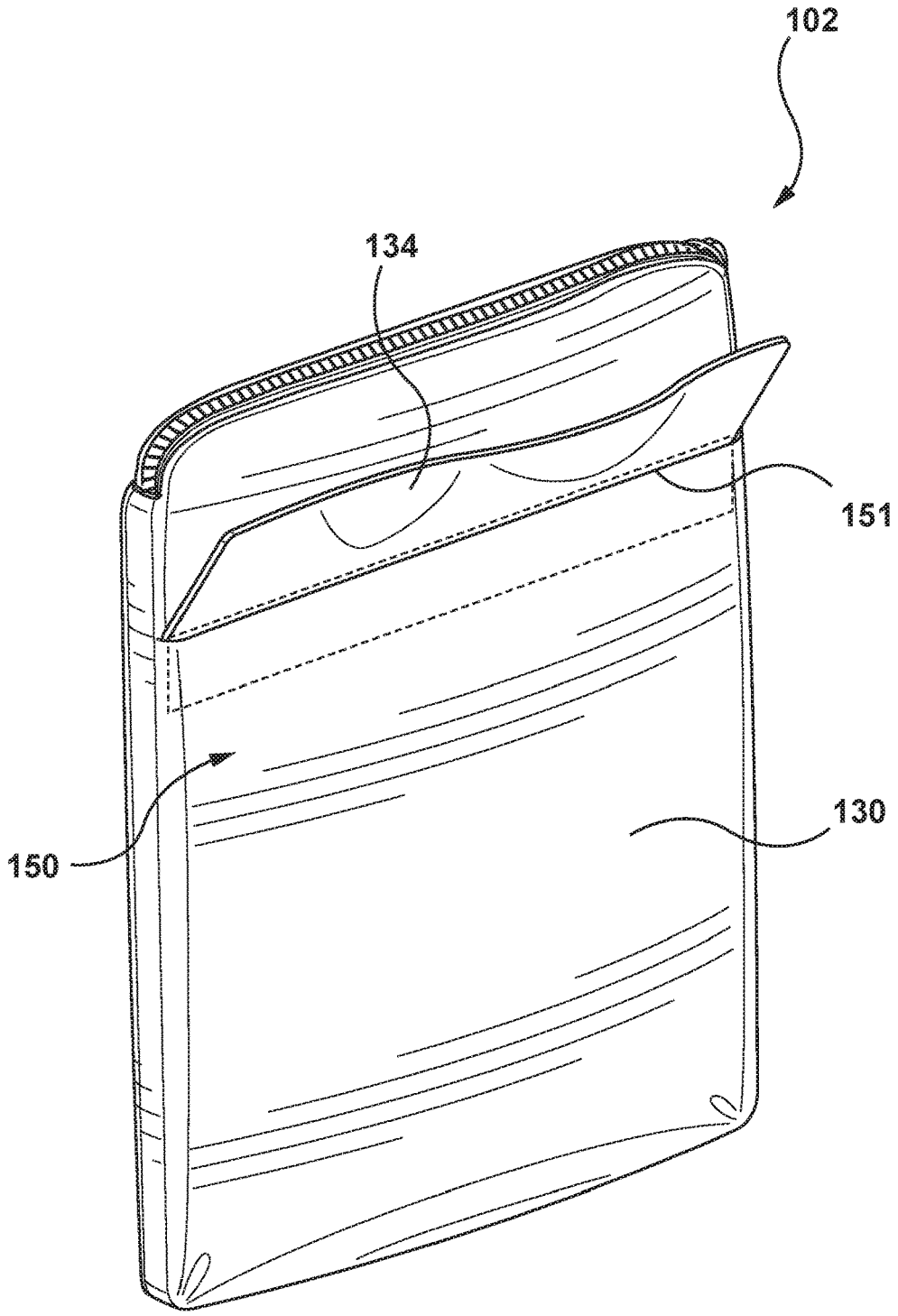
FIG. 8 is a rear perspective view of the sleeve of FIGS. 2-3 including a connective panel for coupling the sleeve to the backpack portion of the backpack of FIG. 1.

In an embodiment, an inner surface of the rear panel 104 of the backpack portion 101 may be attached to the first end of the rear panel 130 of the sleeve 102. In some embodiments, the sleeve 102 is coupled to the inner surface of the rear panel 104 of the backpack portion 101 along only a single edge of the sleeve (e.g., along the first end 122 of the sleeve). In other embodiments, a connective panel 134 (see FIG. 8) may be attached at one end to the rear panel 130 of the sleeve 102 and at an opposite end to the inner surface of the rear panel 104 of the backpack portion 101. The connective panel 134 secures the sleeve 102 to the backpack portion 101 and is stored in the storage compartment 150 with the backpack portion 101, as explained in more detail below. The connective panel 134 may be a portion of the rear panel 104, or a separate component. The connective panel 134 may be coupled to the rear panel 104 and the storage compartment 150 by methods such as, but not limited to stitching or other methods suitable for the purposes described herein.

The backpack 100 may further include a pair of shoulder straps 121, partially shown in FIG. 1. In an embodiment, the shoulder straps 121 are disposed on the rear panel 104 of the backpack 100. An upper portion of each shoulder strap 121 may be coupled to an upper portion of the rear panel 104, and a corresponding lower portion of each shoulder strap 121 may be coupled to a lower portion of the rear panel 104. The upper and corresponding lower portion of each shoulder strap 121 may be coupled to the rear panel by methods such as, but not limited to stitching, buttons, buckles, or any other method suitable for the purposes described herein. While the upper and corresponding lower portions of each shoulder strap 121 are described herein as coupled to the rear panel 104, this is not mean to limit the design and the upper and corresponding lower portions of each shoulder strap 121 may alternatively be coupled to other panels such as, but not limited to the first or second side panel 108,110, top panel 114, bottom panel 112, or other panels suitable for the purposes described herein. In an embodiment, each shoulder strap 121 is adjustably sizable by any conventional manner for the comfort of a backpack wearer. Alternatively, in another embodiment, the shoulder straps may be sizably fixed. The shoulder straps 121 may be of various configurations The backpack 100 and its components may be made of various flexible materials such as, but not limited to nylon, polyester, neoprene, natural fibers, man-made fibers, flexible sheet goods, composites of woven and sheet goods, non-woven textiles, or any other materials suitable for the purposes described herein. The flexibility of the material(s) of the backpack 100 are instrumental in enabling the backpack portion 101 to be manipulated around the sleeve 102 and stored in the storage compartment 150, as described in greater detail below.

The backpack 100 includes a first or backpack configuration wherein the sleeve 102 is disposed within the interior compartment 116 of the backpack portion 101 (FIGS. 1 and 8), and a second or sleeve configuration wherein the backpack portion 101 is disposed within the storage compartment 150 of the sleeve 102 (FIG. 3). The backpack 100 is configured such that the backpack 100 is convertible (may transition) from the first configuration to the second configuration, and conversely, from the second configuration to the first configuration without removal of the laptop 500 disposed within the sleeve 102. More specifically, the backpack 100 is convertible from the first configuration (FIG. 1) to the second configuration (FIG. 3) by manipulating the backpack portion 101 under the sleeve 102 and collapsing the backpack portion 101 into the storage compartment 150 of the sleeve 102, as described in greater detail below.

Referring to FIGS. 4-7, the manner in which the backpack 100 is converted from the second configuration to the first configuration will be described. Although FIGS. 4-8 describe the conversion from the first (backpack) configuration to the second (sleeve) configuration, it is understood that conversion from the second (sleeve) configuration to the first (backpack) configuration entails the same steps in reverse. Further, FIGS. 4-8 show the backpack 100 being converted with the laptop 500 disposed in the sleeve 102.

Figure 4:
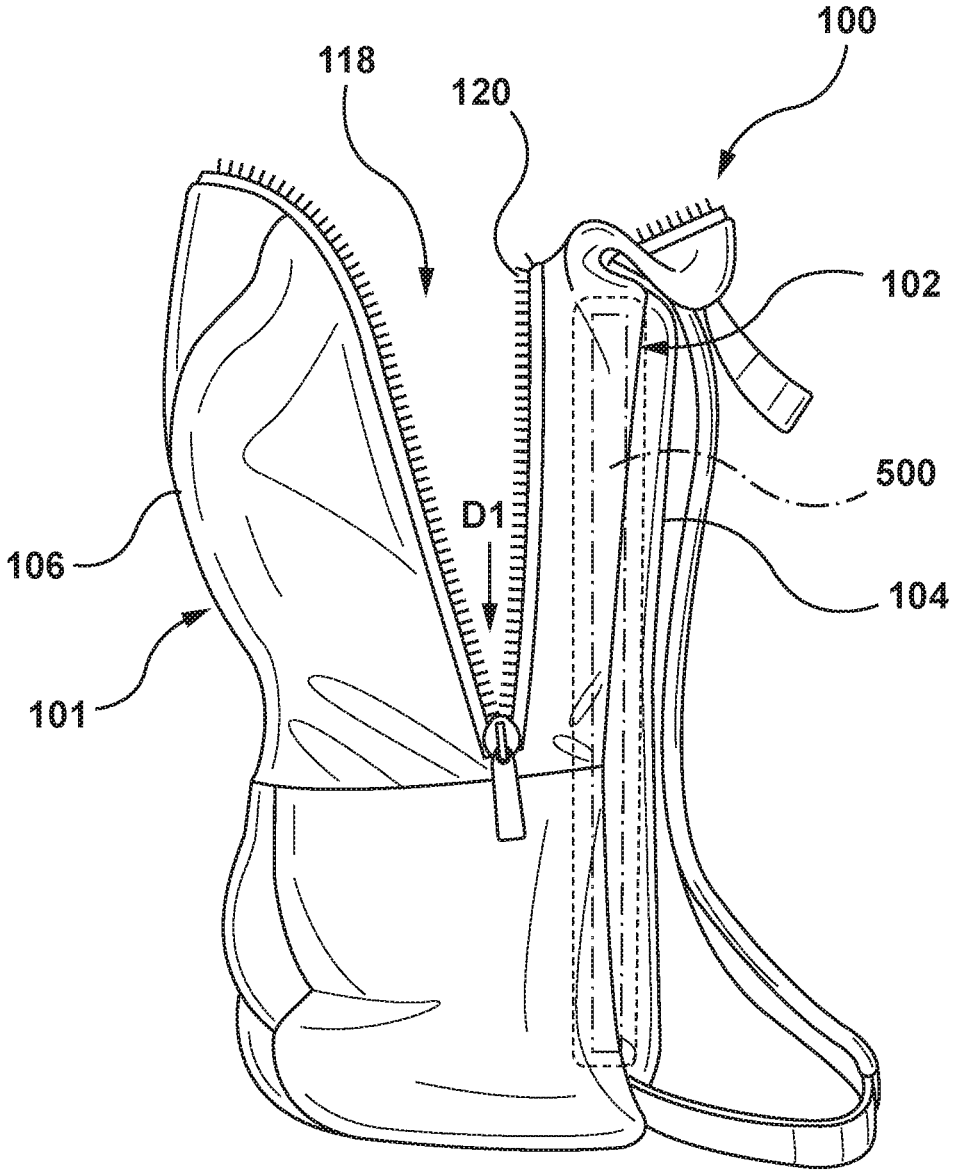
FIGS. 4-7 are illustrations of the transition of the backpack of FIG. 1 from a first configuration of FIG. 1 to a second configuration of FIG. 3.

Referring to FIG. 4, with the backpack 100 in the first configuration, the closure device 120 of the opening 118 is opened. For example, and not by way of limitation, if the closure device 120 is a zipper, the zipper is manipulated (unzipped) in a first direction indicated by arrow D1 along the length of the opening 118 such that a portion of the front panel 106 is separated from a portion of the back panel 104.

Figure 5:
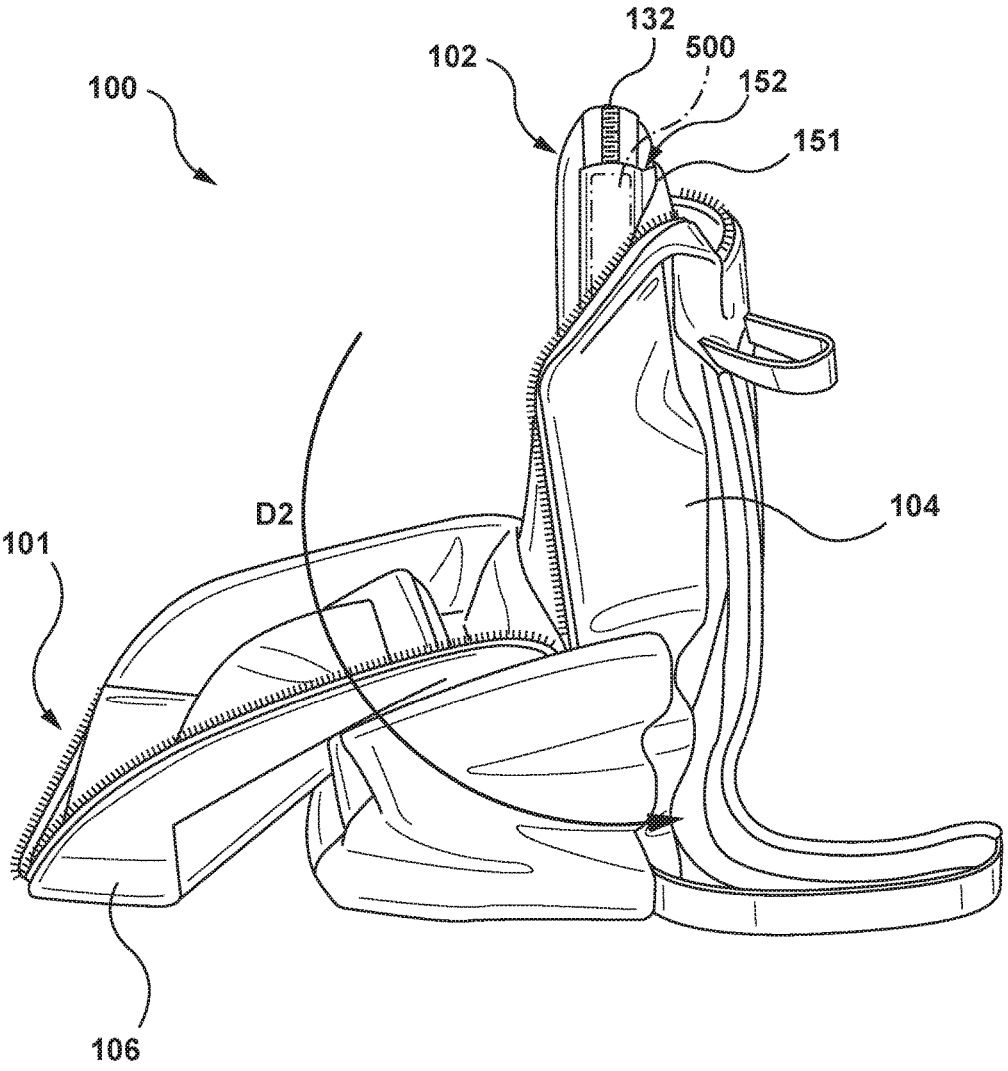
Figure 6:
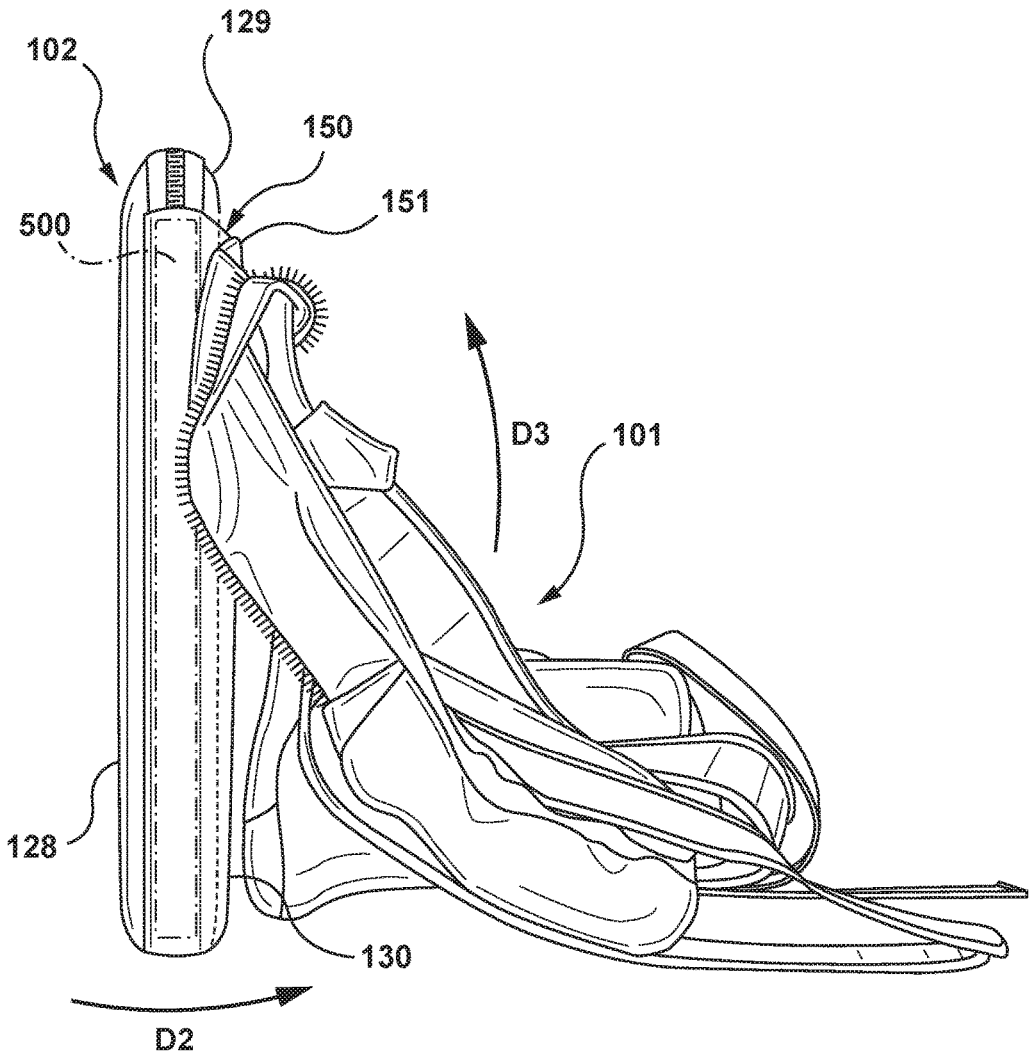
Figure 7:
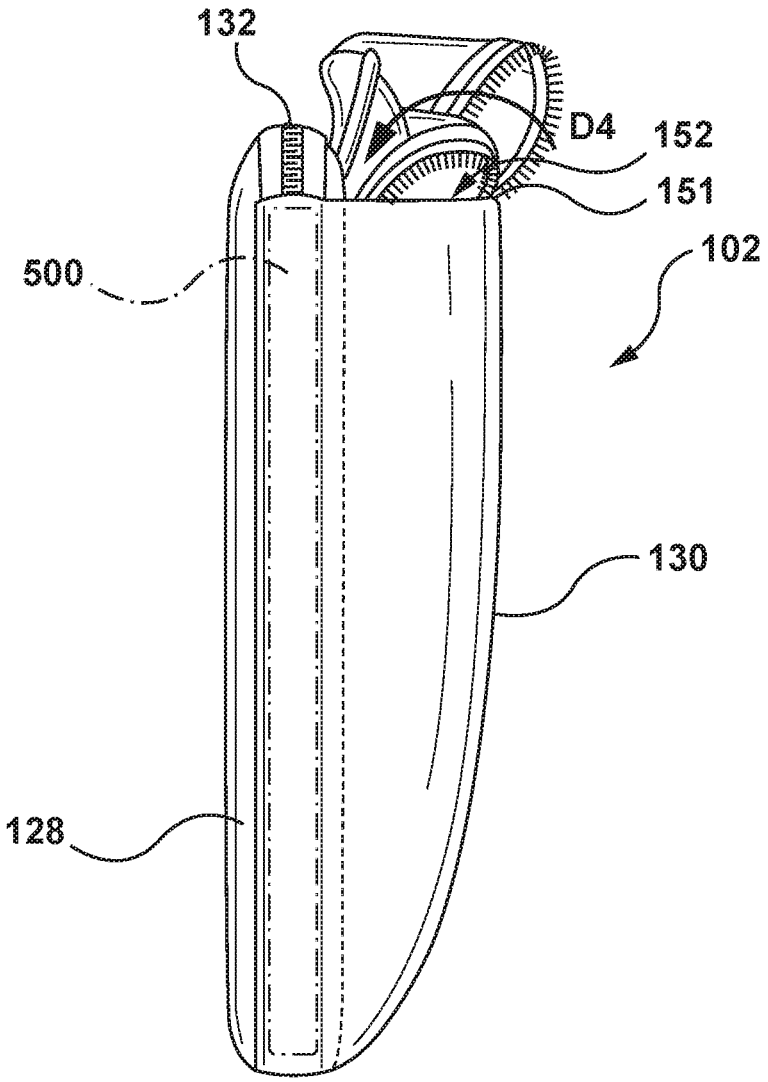

Next, as shown in FIG. 5, the front panel 106 (including adjacent portions of the first side panel 108, the second side panel 110, and the top panel 114) is pulled down in a second direction towards the bottom panel 112, as indicated by arrow D2 in FIG. 5. The front panel 106 of the backpack portion 101 is further pulled under the sleeve 102 such that the backpack portion 101 is disposed on the storage compartment side of the sleeve 102, as shown in FIGS. 5-6 and indicated by arrow D2. Then, the backpack portion 101 is pulled upward in a third direction D3 (shown in FIG. 6), along the outer surface of the rear panel 130 of the sleeve 102 (in essence, turning the backpack portion 101 inside-out). Finally, the backpack portion 101 (including the rear panel 104, the front panel 106, the first side panel 108, the second side panel 110, the bottom panel 112, and the top panel 114) is collapsed (packed, stuffed or otherwise compacted) in a fourth direction D4 into the storage compartment 150 of the sleeve 102, as shown in FIG. 7. The backpack 100 is thus converted from the backpack configuration with the backpack portion 101 housing the sleeve 102 therein (FIG. 1) to the sleeve configuration with the laptop 500 in the interior cavity 126 and a stored backpack portion 101 portion collapsed and stored within the storage compartment 150 of the sleeve 102 (FIG. 3).

Figure 9B:
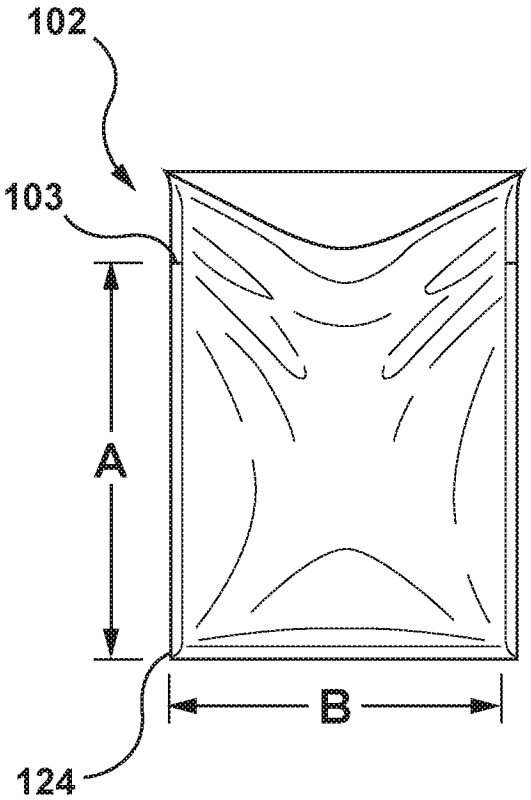
FIGS. 9A-9D are illustrations of the geometric measurements of the backpack of FIG. 1.
Figure 9A:
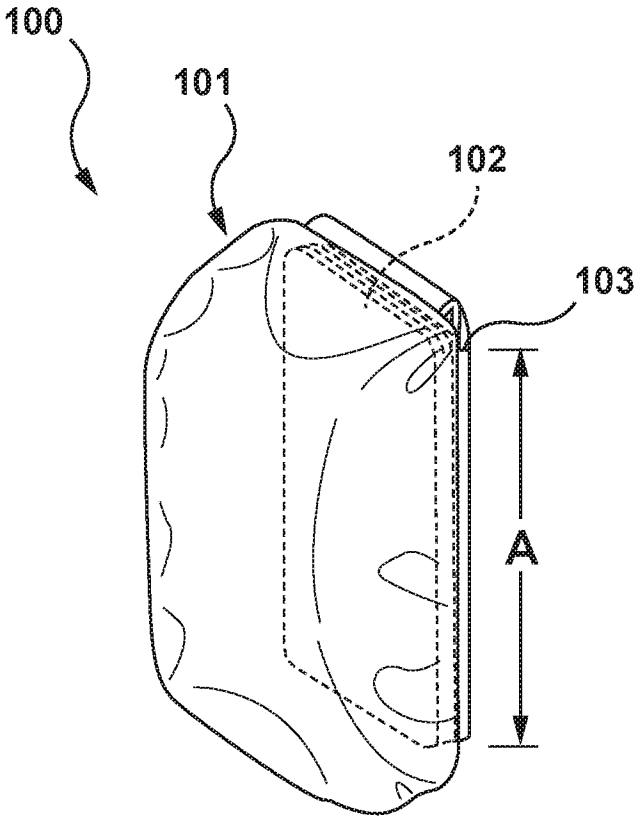
Figure 9D:
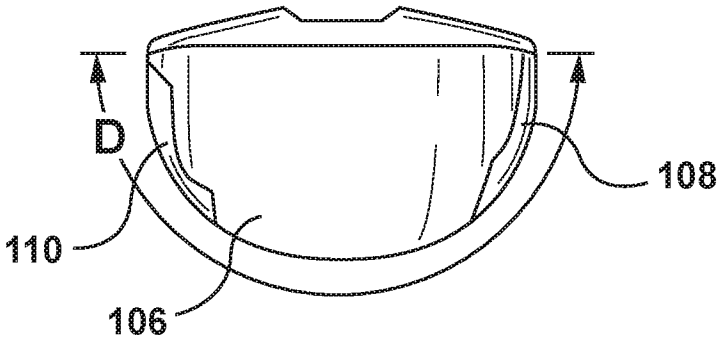
Figure 9C:
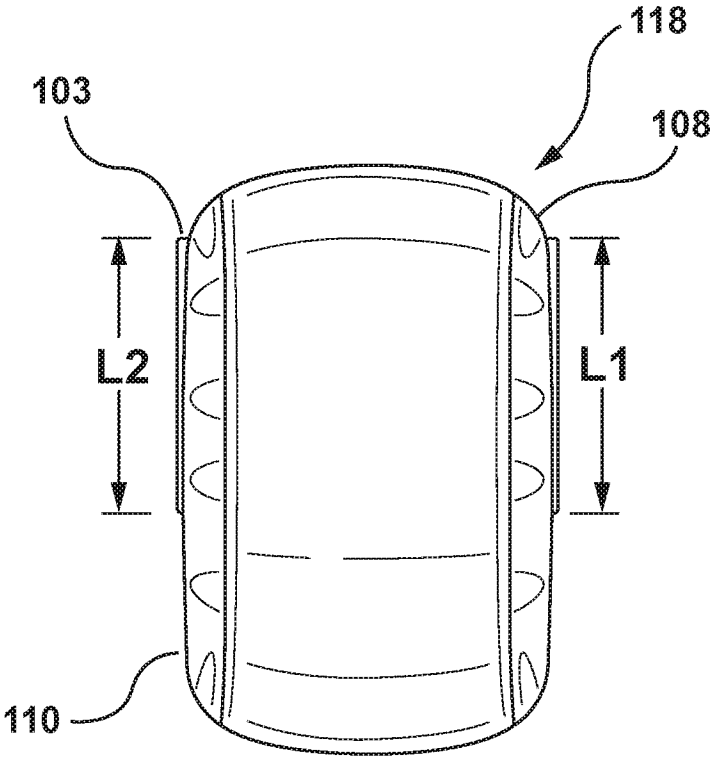

The ability of the backpack 100 to transition from/to the first configuration to/from the second configuration without removing the laptop 500 from the sleeve 102 is predicated on a first length L1 of the first portion 117 of the opening 118 along the first side panel 108, and a corresponding second length L2 (not visible in FIG. 1) of the corresponding second portion 119 of the opening 118 along the second side panel 110, as shown in FIG. 1. More specifically, the first and second lengths L1, L2 are determined based upon the specific geometry of the backpack 100, as defined by the dimensions shown in FIGS. 9A-9D and applied to the following equation. FIG. 9A shows a radius of rotation A. The radius of rotation A is shown in greater detail in FIG. 9B and is defined as the length from an attachment point 103 (where the backpack portion 101 connects to the sleeve 102) extending to the second end 124 of the sleeve 102. The width B of the sleeve 102 is also shown in FIG. 9B. FIG. 9C shows the length L (L1 and L2) from the center of the sleeve rotation (attachment point 103) extending to the end of the portion of the opening 118 along the first and second side panels 108,110, respectively. Finally, FIG. 9D shows the horizontal cross-sectional perimeter D of the front, first, and second side panels 106, 108, 110 measured at the ends of the opening 118 (FIG. 9C). The equation for the calculation of lengths L1 and L2 on the first and second sides 108/110 is:

$$2A+B \leq L1+L2+D \tag{1}$$

Solving for L1+L2:

$$L1+L2 \geq 2A+B-D \tag{2}$$

Therefore, according to the equations above, the combined length of the opening on each side of the backpack portion 101 is greater than or equal to 2A+B−D, as defined above. If the L1 and L2 are equal, then:

$$L1 \geq (2A+B-D)/2 \tag{3}$$

and $$L2 \geq (2A+B-D)/2 \tag{4}$$

However, it is noted that L1 and L2 need not be equal, hence equation (2).

The dimensions noted above have been described with respect to the embodiment of FIGS. 1-3. However, they are also applicable to the other embodiments described herein.

Figure 10:
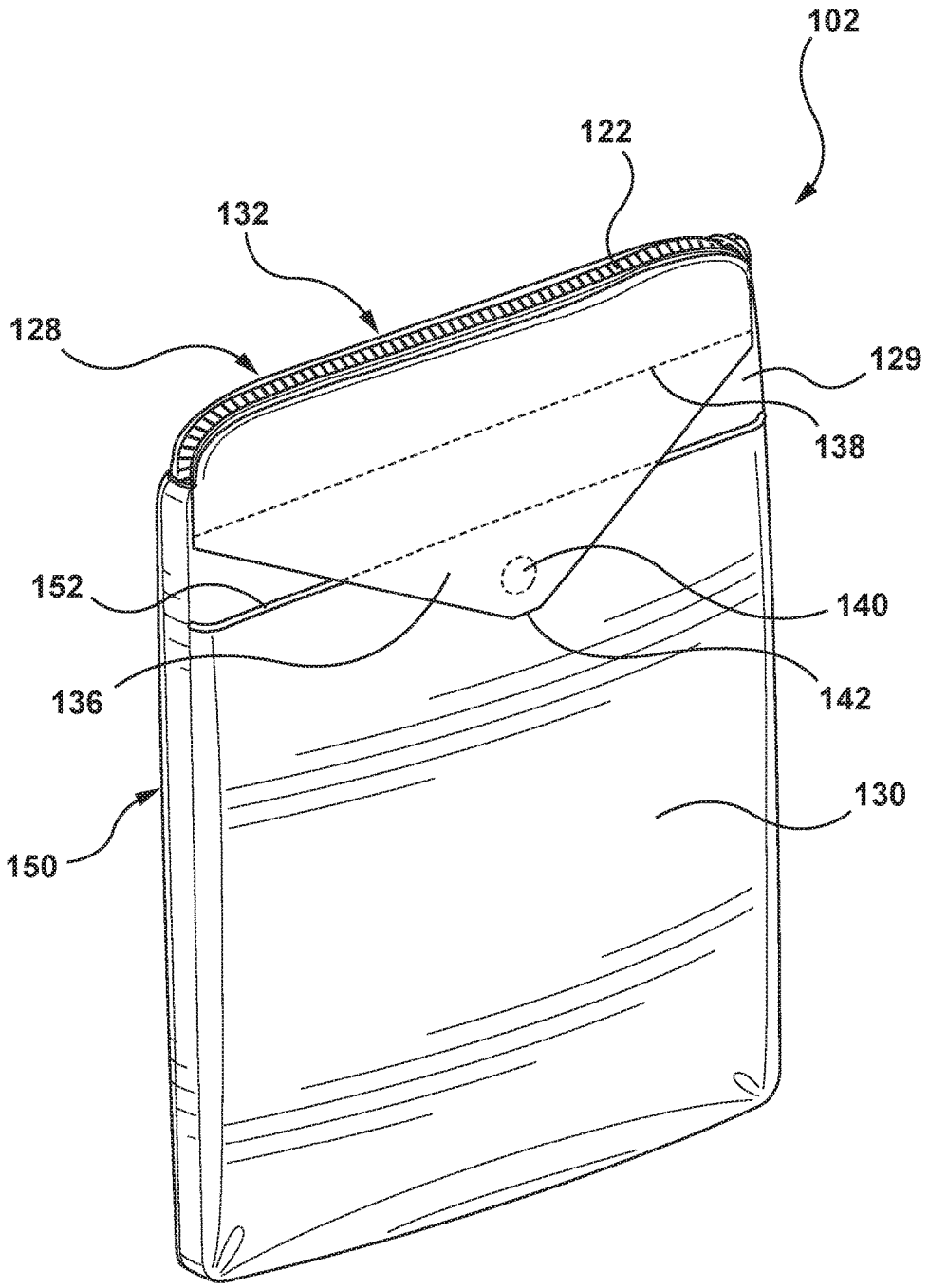
FIG. 10 is a rear perspective view of the sleeve of FIGS. 2-3 with an alternative closure device.

FIG. 10 shows an alternative embodiment for a closure mechanism 132 of the sleeve 102. In the embodiment shown in FIG. 10, a flap 136 is a closure mechanism for both the opening 127 leading to the internal cavity 126 and the opening 152 leading to the storage compartment 150. In particular, a first end 138 of the flap 136 is attached to the outer surface of the front panel 128 of the sleeve 102 by any suitable method, such as, but not limited to stitching. The flap 136 extends over the opening 127 and down a portion of the outer surface the rear panel 130 of the sleeve 102. A first portion of a closure mechanism 140 is disposed adjacent a second end 142 of the flap 136. The first portion of the closure mechanism 140 is configured to engage a corresponding second portion of the closure mechanism 140 disposed on an outer surface of the rear panel 130 of the sleeve 102. The flap 136 is configured such that when the first portion and the second portion of the closure mechanism 140 are engaged, the flap 136 overlaps and releasably secures (closes) the opening 127 between the front panel 128 and the intermediate panel 129 of the sleeve 102 and the opening 152 between the intermediate panel 129 and the rear panel 130 of the sleeve 102. The closure mechanism 140 of the sleeve 102 may be any closure mechanism such as, but not limited to a hook and loop fastener, a button, a snap, or other mechanisms suitable for the purposes described herein. Additionally, while the flap 136 is described as extending from the outer surface of the front panel 128 to the outer surface of the rear panel 130 of the sleeve 102, this is not meant to limit the design, and the flap 136 may include other configurations such as, but not limited to the flap 136 extending from an inner surface of the front panel 128 of the sleeve 102, the flap 136 extending to an inner surface of the rear panel 130 of the sleeve 102, or any combination suitable for the purposes described herein. Moreover, while the flap is shown in FIG. 10 as releasably securing both the opening 127 and the opening 152, in other embodiments, the flap 136 may extend only to the intermediate panel 129 such that the flap 135 only releasably secures the opening 127.

Figure 11:
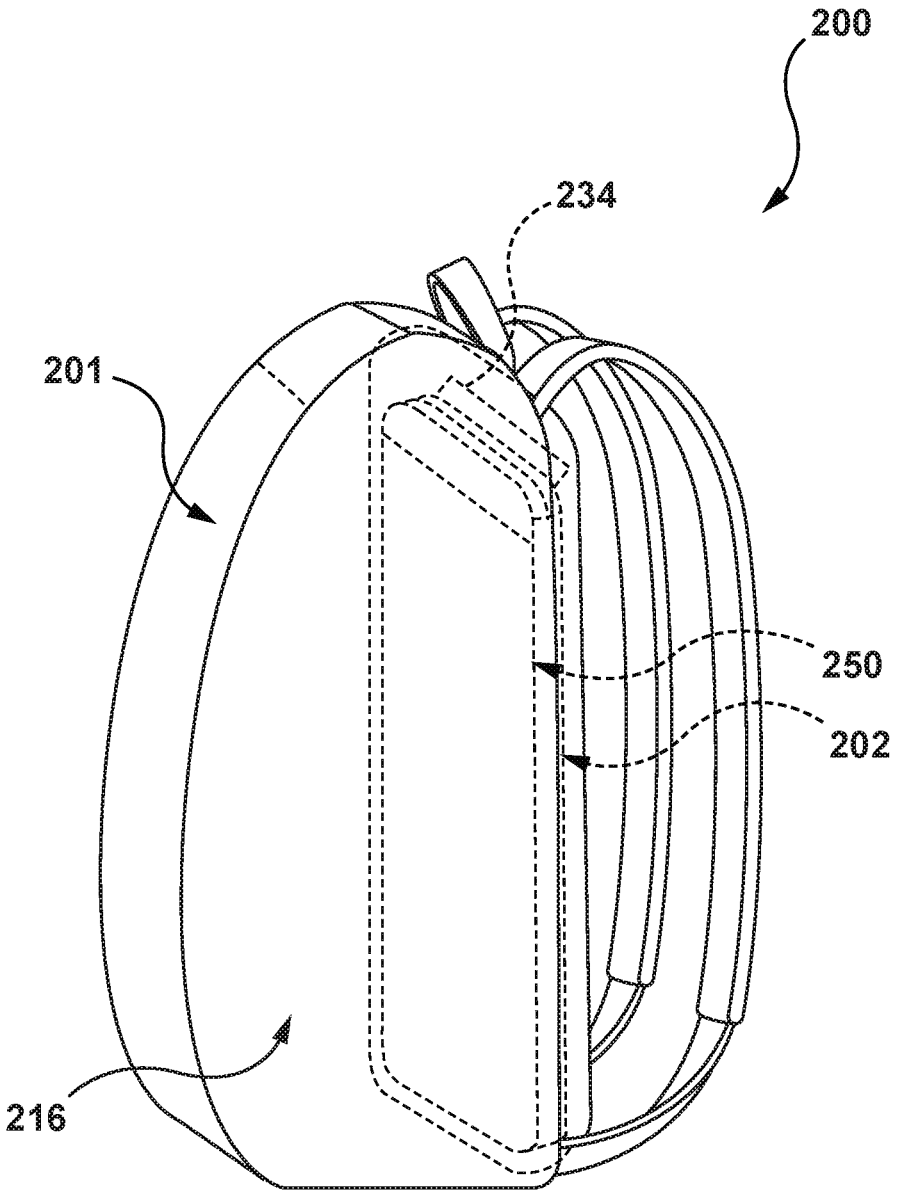
FIG. 11 is a perspective illustration of a backpack in accordance with another embodiment hereof.
Figure 12:
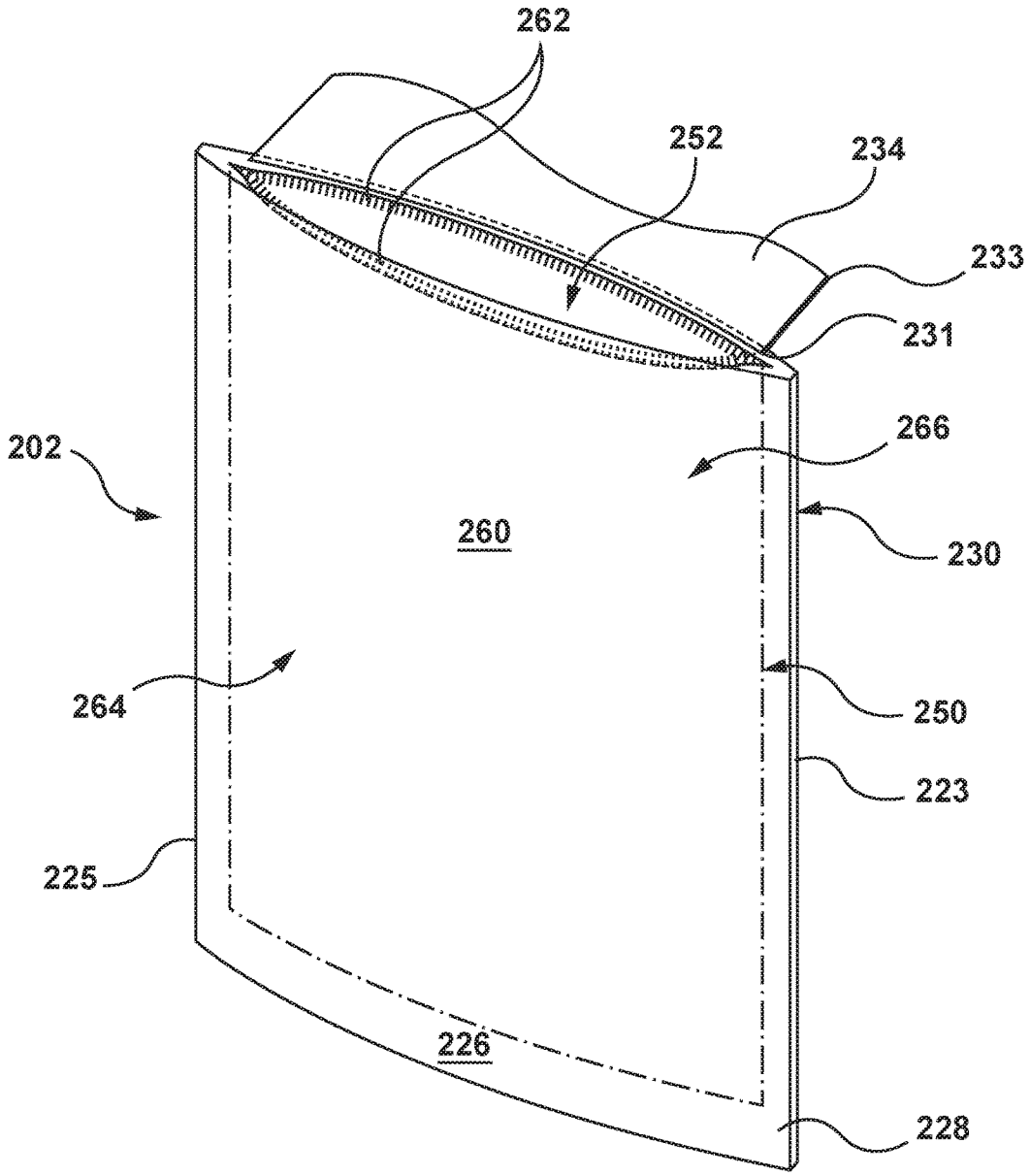
FIG. 12 is a perspective illustration of a sleeve of the backpack of FIG. 10 in accordance with an embodiment hereof.
Figure 13:
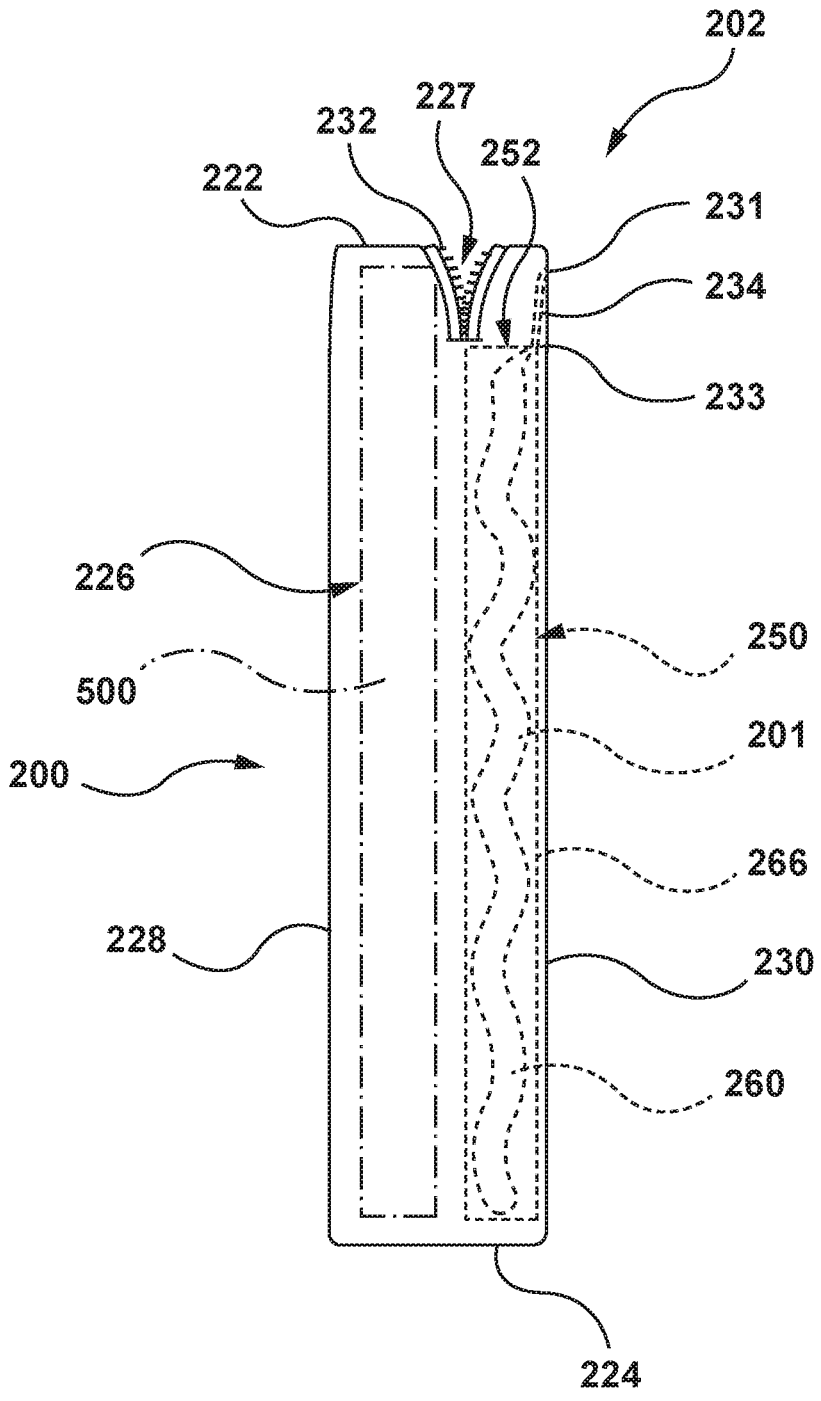
FIG. 13 is a side illustration of the backpack of FIG. 10 in the second configuration.

Referring to FIGS. 11-13, another embodiment of a backpack 200 is shown therein. The backpack 200 includes a backpack portion 201 and a sleeve 202, as shown in FIG. 11. The sleeve 202 includes an interior cavity 226 and a storage compartment 250. The backpack portion 201 and the sleeve 202 are similar to the backpack portion 101 and the sleeve 102 described above. Therefore, many of the construction details and alternatives of the backpack portion 201 and the sleeve 202 will not be repeated with respect to the present embodiment. However, in the embodiment of FIGS. 10-12, the storage compartment 250 is disposed within the interior cavity 226 of the sleeve 202.

In an embodiment, similar to the embodiment of FIGS. 1-3, the sleeve 202 includes a front panel 228 and a rear panel 230. The front panel 228 and the rear panel 230 are coupled to each other along a second end 224 and first and second sides 223, 225 thereof, such as by stitching. The front panel 228 and the rear panel 230 form the interior cavity 226 therebetween. At a first end 222 of the sleeve 202, the front and rear panels 228, 230 form an opening 227 providing access to the interior cavity 226. A closure device 232, as described above, may be provided to releasably secure the opening 227.

In an embodiment, the storage compartment 250 is disposed within the interior cavity 226 and includes a front panel 264 and a rear panel 266 opposite the front panel 264 defining the storage compartment 250, as shown in FIGS. 12-13. The storage compartment 250 is configured to accept the backpack portion 201 of the backpack 200 when the backpack 200 is in a second (sleeve) configuration. In an embodiment, the storage compartment 250 is disposed on an inner surface of the rear panel 230 of the sleeve 202. More specifically, an outer surface of the rear panel 266 of the storage compartment 250 is coupled to an inner surface of the rear panel 230 of the sleeve 202, as shown in FIGS. 12 and 13. The storage compartment 250 may be coupled to the rear panel 230 methods such as, but not limited to stitching, adhesives, radio frequency welding, or other methods suitable for the purposes described herein. While the embodiment described in FIGS. 11-13 includes the storage compartment 250 permanently coupled (attached) to the rear panel 230, in an alternative embodiment the storage compartment 250 may be releasably coupled to the rear panel 230 such that the storage compartment 250 may be separated from the rear panel 230. The storage compartment 250 may be releasably coupled to the rear panel 230 by methods such as, but not limited to a separating zipper, hook and loop material, or other methods understood by one skilled in the art and suitable for the purposes described herein.

In an embodiment, a connective panel 234 is coupled at a first end 231 to an inner surface of the rear panel 230 of the sleeve 202 and at a second end 233 to an inner surface of the rear panel of the backpack portion 201 to couple the sleeve 202 to the backpack portion 201. The first end 231 of the connective panel 234 is coupled to the inner surface of the rear panel 230 adjacent the opening 227. In some embodiments, the first end 231 of the connective panel 234 is coupled to the sleeve 202 along only a single edge of the sleeve 202 (e.g., along the first end 222 of the sleeve 202). As shown in FIG. 13, when the backpack portion 201 is stored in the storage compartment 250, connective panel 234 extends from the first end 231 into the storage compartment 250. In other embodiments, the first end 231 of the connective panel 234 may be coupled to an inner surface of the rear panel 266 of the storage compartment 250 adjacent opening 252 of the storage compartment 250. In other embodiments, the inner surface of the rear panel of the backpack portion 201 may be couple to the inner surface of the rear panel 230 of the sleeve 202, as described above.

The backpack 200 includes a first or backpack configuration wherein the sleeve 202 is disposed within an interior compartment 216 of the backpack portion 201, as shown in FIG. 10. The backpack 200 further includes a second or sleeve configuration wherein the backpack portion 201 is disposed within the storage compartment 250, as shown in FIG. 13. The backpack 200 is further configured such that the backpack 200 may transition (convert) from the first configuration to the second configuration and back without removal of a laptop 500 disposed within the sleeve 202, as described above with respect to backpack 100.

In the embodiment of FIGS. 11-13, the transition of the backpack 200 from the first configuration to the second configuration is similar to the conversion of the backpack 100, described previously. However, to complete the transition, the backpack 200 is collapsed (packed, stuffed, or otherwise compacted) within the storage compartment 250 within the interior cavity 226 of the sleeve 202, as shown in FIG. 13.

While the embodiment of FIGS. 11-13 show storage compartment 250 as a separate storage compartment coupled to an inner surface of the rear panel 230 of the sleeve 202, this is not meant to limit the design, and other configurations are possible. As an example, in another embodiment, the storage compartment 250 may be a slash pocket coupled to the inner surface of the rear panel 230 of the sleeve 202 and accessible through the interior cavity of the sleeve 202. Such an embodiment is similar to the embodiment of FIGS. 1-3 except that the slash pocket is coupled to an inner surface of the rear panel of the sleeve instead of an outer surface of an intermediate panel of the sleeve.

Figure 14:
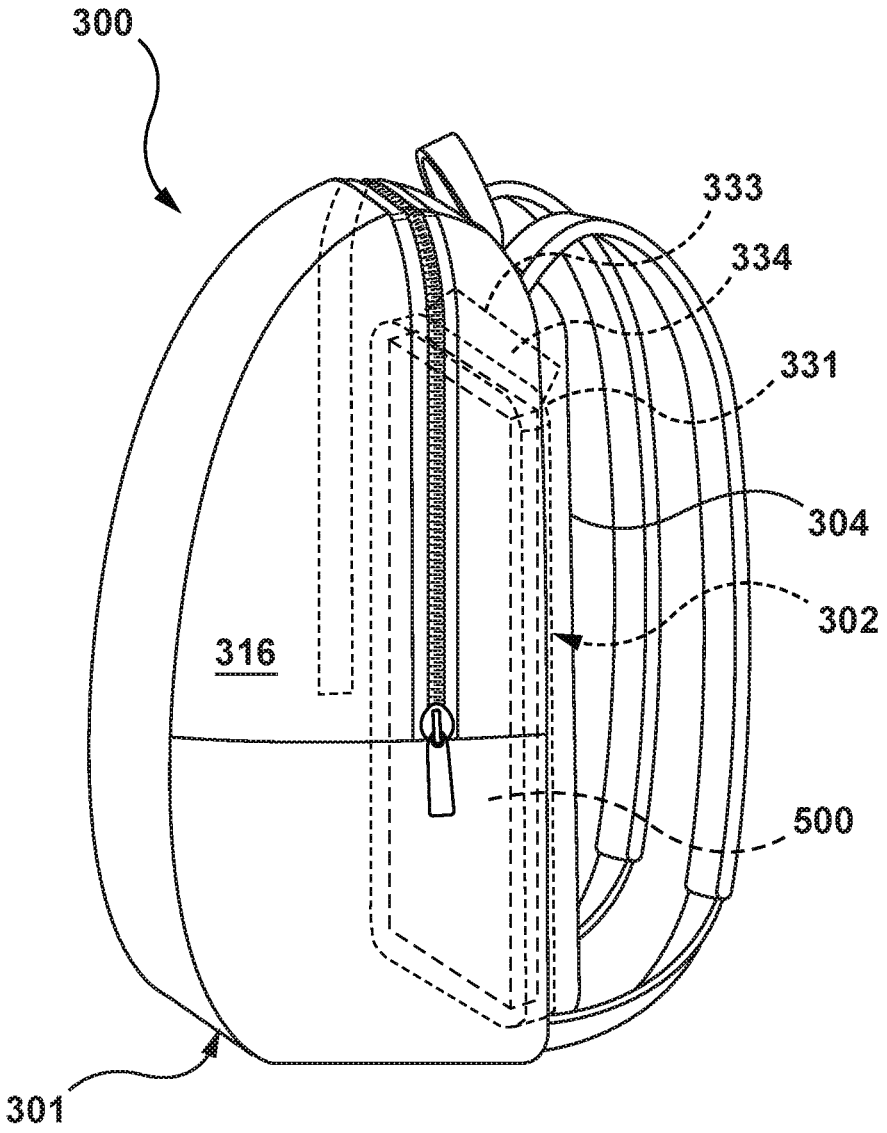
FIG. 14 is a perspective illustration of a backpack in accordance with another embodiment hereof.
Figure 15:
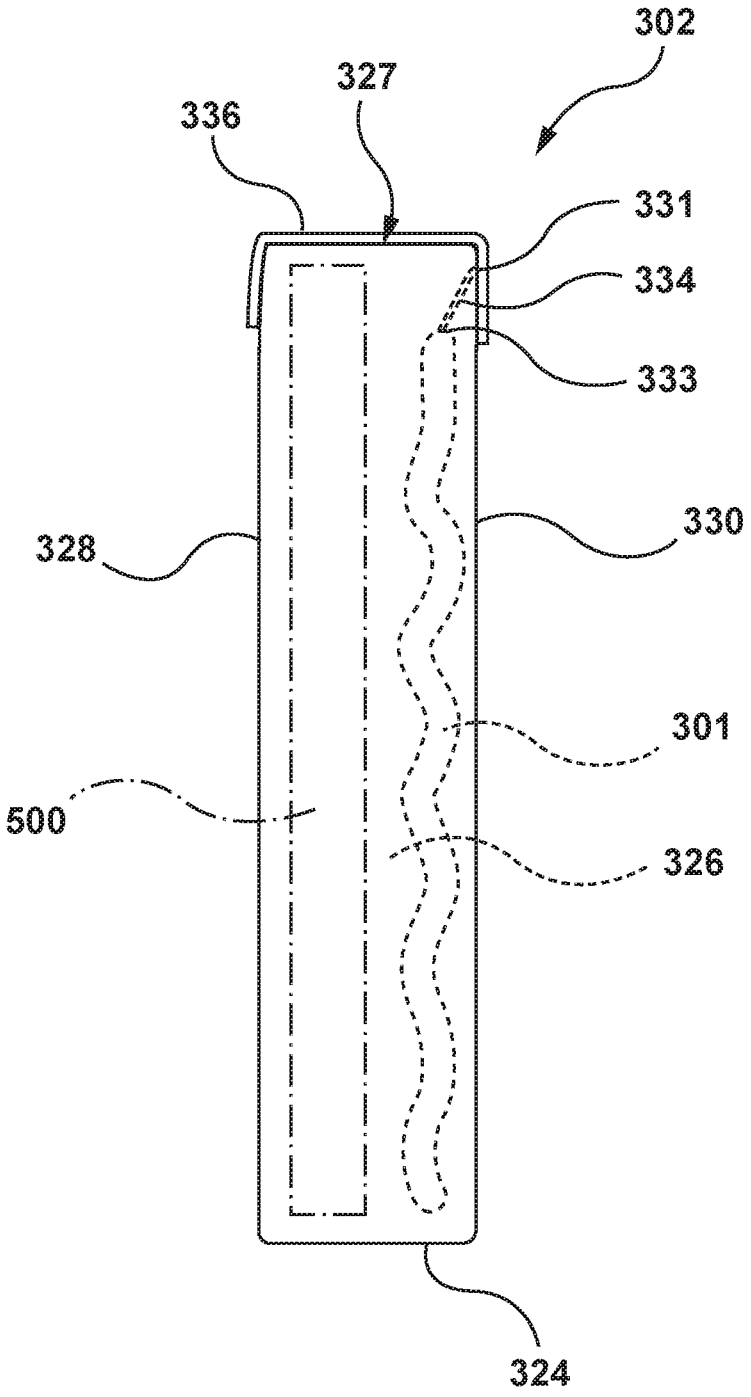
FIG. 15 is a side illustration of a sleeve of the backpack of FIG. 14 in accordance with an embodiment hereof.
Figure 16:
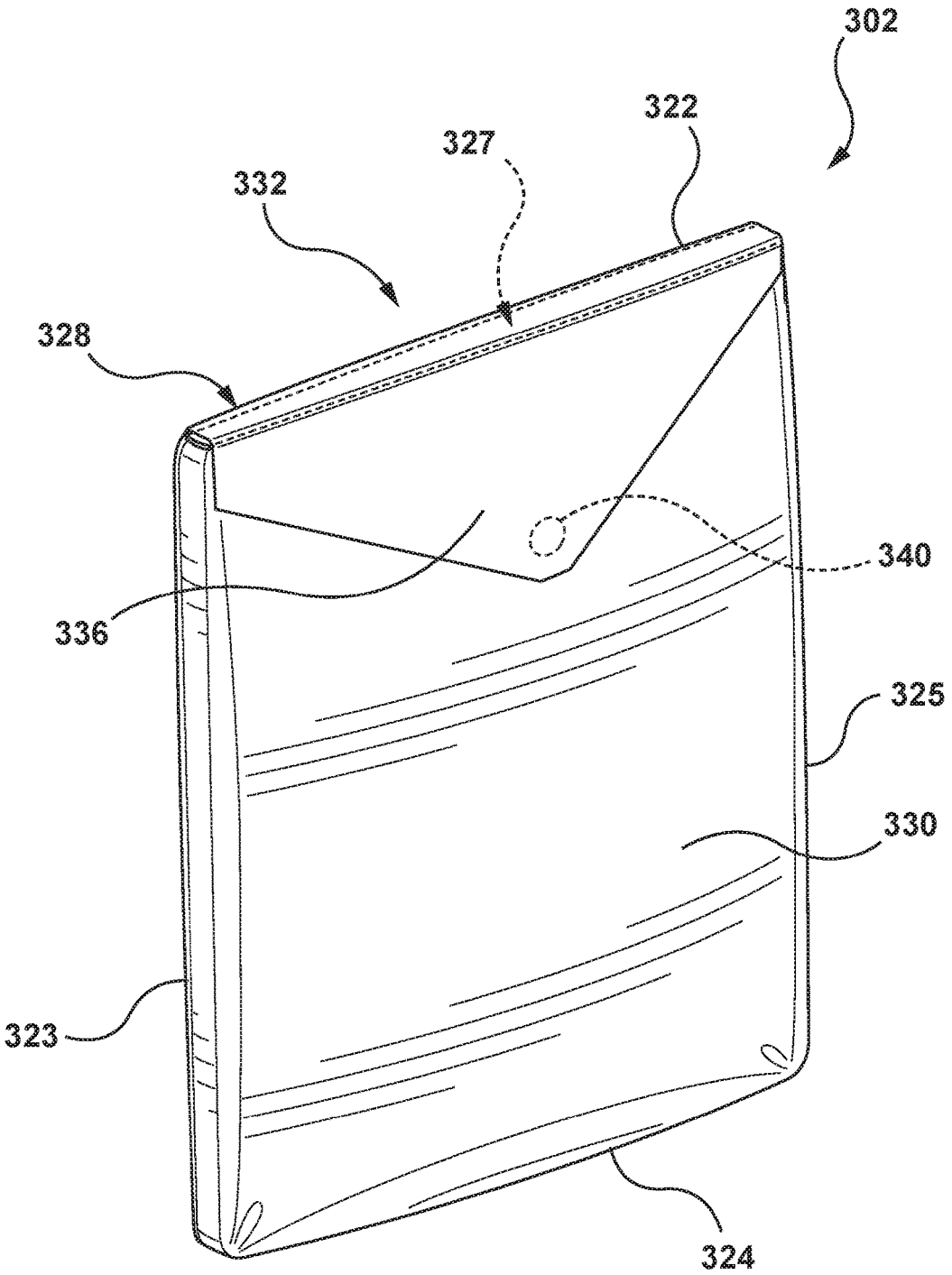
FIG. 16 is a perspective illustration of the backpack of FIG. 14 in the second configuration.

Referring to FIGS. 14-16, another embodiment of a backpack 300 is shown therein. The backpack 300 includes a backpack portion 301 and a sleeve 302. In the embodiment of FIGS. 14-16, the backpack portion 301 and the sleeve 302 are similar to the backpack portion 101 and the sleeve 102, described previously and shown in FIGS. 1-3. However, in the embodiment of the backpack 300, the sleeve 302 includes a single compartment configured to receive both the laptop 500 and the backpack portion 301 therein. More specifically, the sleeve 302 is configured to be both a sleeve for the laptop 500 and a storage compartment for the collapsed backpack portion 301.

Thus, referring to FIG. 15, the sleeve 302 includes a rear panel 330 and a front panel 328. The front and rear panels 328, 330 are coupled to each other along a second end 324 and first and second sides 323, 325, such as by stitching. The front and rear panels 328, 330 form an interior cavity 326 therebetween with an opening 327 at a first end 322 for access to the interior cavity. A closure device 332 releasably closes the opening 327. In the embodiment shown, the closure device 332 of the sleeve 302 is a flap 336, as shown in FIG. 16. The flap 336 may be similar to the flap 136 described previously, and therefore details of the flap 336 will not be repeated. The flap 336 is configured to overlap and releasably secure (close) the opening 327 of the sleeve 302 with a closure mechanism 340. While the closure device 332 is shown in FIGS. 14-16 as a flap 336, this is not meant to limit the design, and the closure device 332 of the sleeve 302 may be a zipper, hook and loop mechanism, buttons, snaps, or any other closure mechanism suitable for the purposes described herein.

In the embodiment of FIGS. 14-16, the backpack 300 further includes a connective panel 334, as shown in FIGS. 14-15. The connective panel 334 includes a first end 331 coupled to a rear panel 330 of the sleeve 302 adjacent an opening 327 and a second end 333 coupled to an inner surface of the rear panel 304 of the backpack portion 301. The connective panel 334 may be a portion of the rear panel 304, the rear panel 330, or a separate component. In some embodiments, the first end 331 of the connective panel 334 is coupled to the sleeve 302 along only a single edge of the sleeve 302 (e.g., along the first end 322 of the sleeve 302). Alternatively, as described above with respect to FIGS. 1-3, the inner surface of the rear panel 304 of the backpack portion 301 may be directly coupled to the sleeve 302. The connective panel 334 may be coupled to the sleeve 302 and the rear panel 304 by methods such as, but not limited to stitching or other methods suitable for the purposes described herein.

The backpack 300 includes a first or backpack configuration wherein the sleeve 302 is disposed within an interior compartment 316 of the backpack portion 301 (FIG. 14), and a second or sleeve configuration wherein the backpack portion 301 is disposed within the sleeve 302 (FIG. 15). The backpack 300 is further configured such that the backpack 300 may transition (convert) from the first configuration to the second configuration and back without removal of a laptop 500 disposed within the sleeve 302. In the embodiment of FIGS. 14-16, the transition of the backpack 300 from the first configuration to the second configuration is similar to the conversion of the backpack 100, described previously. However, to complete the transition, the backpack 300 is collapsed (packed, stuffed, or otherwise compacted) within the interior compartment 326 of the sleeve 302 adjacent with the laptop 500, as shown in FIG. 15.

While only some embodiments have been described herein, it should be understood that it has been presented by way of illustration and example only, and not limitation. Various changes in form and detail can be made therein without departing from the spirit and scope of the invention, and each feature of the embodiments discussed herein can be used in combination with the features of any other embodiment. All patents and publications discussed herein are incorporated by reference herein in their entirety.

What is claimed is:

1. A backpack, comprising:

a backpack portion including a front panel, a rear panel, a first side panel, a second side panel, a bottom panel, and a top panel defining an interior compartment accessible through an opening; and a sleeve defining an interior cavity configured to receive a laptop therein and a storage compartment configured to receive the backpack portion therein, wherein the sleeve is attached to an inner surface of the rear panel of the backpack portion, wherein the backpack includes a first configuration and a second configuration, wherein in the first configuration the sleeve is disposed within the interior compartment of the backpack portion, and in the second configuration the backpack portion is disposed within the storage compartment of the sleeve, wherein in the second configuration, the sleeve is attached to the rear panel of the backpack portion.

2. The backpack of claim 1, wherein the backpack is configured to transition from the first configuration to the second configuration without removal of a laptop from the interior cavity of the sleeve.

3. The backpack of claim 1, wherein the opening is configured with a first portion along the first side panel and a corresponding second portion along the corresponding second side panel such that the backpack is configured to transition from the first configuration to the second configuration without removal of a laptop disposed within the interior cavity of the sleeve.

4. The backpack of claim 1, wherein the sleeve is coupled to the inner surface of the rear panel of the backpack portion along only a single edge portion of the sleeve.

5. A backpack comprising:

a backpack portion including a front panel, a rear panel, a first side panel, a second side panel, a bottom panel, and a top panel defining an interior compartment accessible through an opening; and a sleeve defining an interior cavity configured to receive a laptop therein and a storage compartment configured to receive the backpack portion therein, wherein the sleeve is coupled to an inner surface of the rear panel of the backpack portion, wherein the backpack includes a first configuration and a second configuration, wherein in the first configuration the sleeve is disposed within the interior compartment of the backpack portion, and in the second configuration the backpack portion is disposed within the storage compartment of the sleeve, wherein the sleeve includes a sleeve front panel, a sleeve rear panel, and a sleeve intermediate panel disposed between the sleeve front panel and the sleeve rear panel, wherein the interior cavity of the sleeve is defined between the sleeve front panel and the sleeve intermediate panel, and wherein the storage compartment of the sleeve is defined between the sleeve intermediate panel and the sleeve rear panel.

6. The backpack of claim 5, wherein the sleeve front panel is coupled to the sleeve intermediate panel along respective first and second sides and a second end of each, wherein the sleeve rear panel is coupled to the sleeve intermediate panel along respective first and second sides and a second end of each, wherein a first end of the sleeve front panel and a first end of the sleeve intermediate panel define an interior cavity opening therebetween, wherein a first end of the rear panel and the first end of the sleeve intermediate panel define a storage compartment opening therebetween, and wherein the interior cavity opening provides access to the interior compartment and the storage compartment opening provides access to the storage compartment.

7. The backpack of claim 6, wherein the sleeve further includes a closure device for releasably closing the interior cavity opening.

8. The backpack of claim 5, wherein the sleeve front panel is coupled to the sleeve rear panel along respective first and second sides and a second end of each, wherein the sleeve rear panel is coupled to the sleeve intermediate panel along respective first and second sides and a second end of each, wherein a first end of the sleeve front panel and a first end of the sleeve rear panel define an interior cavity opening therebetween, wherein a first end of the rear panel and the first end of the sleeve intermediate panel define a storage compartment opening therebetween, and wherein the interior cavity opening provides access to the interior compartment, wherein to the storage compartment opening provides access to the storage compartment, and wherein the storage compartment opening is disposed within the interior cavity such that access to the storage compartment opening is through the interior compartment opening.

9. The backpack of claim 8, wherein the sleeve further includes a closure device for releasably closing the interior cavity opening.

10. A backpack comprising:

a backpack portion defining an interior compartment accessible through an opening; and a sleeve defining an interior cavity configured to receive a laptop therein, wherein the sleeve is attached to an inner surface the backpack portion along only a single edge portion of the sleeve, wherein the backpack includes a first configuration and a second configuration, wherein in the first configuration the sleeve is disposed within the interior compartment of the backpack portion, and in the second configuration the backpack portion is disposed within the interior cavity of the sleeve, wherein in the second configuration, the sleeve is attached the backpack portion along the single edge portion of the sleeve.

11. The backpack of claim 10, wherein the backpack is configured to transition from the first configuration to the second configuration without removal of a laptop from the interior cavity of the sleeve.

12. The backpack of claim 10, wherein the opening is configured with a first portion along a first side panel of the backpack portion and a corresponding second portion along a corresponding second side panel of the backpack portion such that the backpack is configured to transition from the first configuration to the second configuration without removal of a laptop disposed within the interior cavity of the sleeve.

13. The backpack of claim 10, wherein the sleeve includes a sleeve front panel and a sleeve rear panel, wherein the interior cavity of the sleeve is defined between the sleeve front panel and the sleeve rear panel, and wherein the sleeve is configured such that in the second configuration, a laptop and the backpack portion are both disposed in the interior cavity of the sleeve.

14. The backpack of claim 13, wherein the sleeve further comprises an interior cavity opening providing access to the interior cavity and a closure device for releasably closing the interior cavity opening.

15. A storage device comprising:

a storage portion defining an interior compartment accessible through an opening; and a sleeve defining an interior cavity and a storage compartment, the interior cavity configured to receive a laptop therein, wherein the sleeve is attached to an inner surface of the storage portion along only a single edge of the sleeve, wherein the storage device includes a first configuration and a second configuration, wherein in the first configuration the sleeve is disposed within the interior compartment of the storage portion, and in the second configuration the storage portion is disposed within the storage compartment of the sleeve, wherein in the second configuration, the sleeve is attached to the storage portion.

16. The storage device of claim 15, wherein the storage device is configured to transition from the first configuration to the second configuration without removal of a laptop from the interior cavity of the sleeve.

17. The storage device of claim 15, wherein the storage portion further includes an opening for access to the interior compartment of the storage portion, wherein the opening is configured with a first portion along a first side panel of the storage portion and a corresponding second portion along a corresponding second side panel of the storage portion, wherein the storage device is configured to transition from the first configuration to the second configuration without removal of a laptop disposed within the interior cavity of the sleeve.

* * * * *